US005803051A

United States Patent [19]

Stehr

[11] Patent Number: 5,803,051

[45] Date of Patent: Sep. 8, 1998

[54] FUEL DISTRIBUTION ARRANGEMENT FOR AN INTERNAL COMBUSTION ENGINE

[75] Inventor: Hartmut Stehr, Gifhorn, Germany

[73] Assignee: Volkswagen AG, Wolfsburg, Germany

[21] Appl. No.: 916,149

[22] Filed: Aug. 21, 1997

[30] Foreign Application Priority Data

Aug. 24, 1996 [DE] Germany ..... 196 34 260.0

[51] Int. Cl.[6] ..... F02M 37/04

[52] U.S. Cl. ..... 123/456; 123/468

[58] Field of Search ..... 123/456, 468, 123/469, 470, 472, 509, 446

[56] References Cited

U.S. PATENT DOCUMENTS

| | | | |
|---|---|---|---|
| 3,125,078 | 3/1964 | Reiners | 123/468 |
| 4,922,958 | 5/1990 | Kemp | 123/456 |
| 4,955,409 | 9/1990 | Tokuda | 123/456 |
| 5,022,371 | 6/1991 | Daly | 123/468 |
| 5,121,731 | 6/1992 | Jones | 123/470 |
| 5,273,007 | 12/1993 | Ampferer | 123/90.34 |
| 5,295,467 | 3/1994 | Hafner | 123/456 |
| 5,299,540 | 4/1994 | Fransson | 123/468 |
| 5,392,749 | 2/1995 | Stockner | 123/456 |
| 5,595,160 | 1/1997 | Matsumoto | 123/456 |

FOREIGN PATENT DOCUMENTS

| | | |
|---|---|---|
| 0625637 | 11/1994 | European Pat. Off. . |
| 3905254 | 2/1989 | Germany . |
| 4019766 | 6/1990 | Germany . |

*Primary Examiner*—Carl S. Miller
*Attorney, Agent, or Firm*—Baker & Botts, L.L.P.

[57] ABSTRACT

To provide a uniform temperature level for fuel supplied to individual cylinders of an internal combustion engine, a fuel-carrying passage is formed in a cylinder head and an insert formed with outflow orifices and supports extending along its outer surface is mounted in the passage. Because the insert acts as a countercurrent heat exchanger, and as a result of intermixing of fuel streams emerging through the outflow orifices, a uniform temperature of the fuel supplied through transverse lines to the fuel injectors is obtained.

8 Claims, 1 Drawing Sheet

FUEL DISTRIBUTION ARRANGEMENT FOR AN INTERNAL COMBUSTION ENGINE

BACKGROUND OF INVENTION

This invention relates to arrangements for the distribution of fuel in internal combustion engines provided with a cylinder head containing a fuel supply passage.

German Offenlegungsschrift No. 39 05 254 discloses a cylinder head and a housing which is held separately on the cylinder head or on intake pipes and which has fuel injection valves extending transversely to the housing. Furthermore, the housing contains a fuel supply duct which is connected through transverse bores to the injection valves. A separate blower directs a continuous stream of cooling air through the housing so that the injection valves are cooled by the air stream. This arrangement is intended to equalize the cooling effect for all of the injection valves. This is accomplished because the entire stream of cooling air is directed to all of the injection valves, i.e. it is introduced from the blower at one end of the housing and discharged from the opposite end of the housing.

Furthermore, so-called fuel distributor strips for internal combustion engines are also known in the prior art. These are, as a rule, assigned to the intake pipes of an internal combustion engine and have a central supply point for fuel, a fuel pressure regulator and a fuel return and are provided with separate outlets for the individual injection valves. One such arrangement is disclosed, for example, in European Published Application No. 0 625 637 in which a central supply point for fuel is provided. This arrangement conveys the fuel into an inner tube which is disposed within an outer tube and which is provided with transverse bores on the end face through which fuel can flow from the inner tube into a coaxially positioned outer cavity. The outer cavity is connected through transverse connection ducts to the individual injection valves. In this case, the inner tube is held in the outer tube by ribs extending over a limited axial length. Such arrangements are intended to provide a subassembly of modular design which saves constructional space. There is no disclosure relating to any aspect of fuel cooling or equalization of fuel temperature. Nor are these functions provided in such arrangements, since, as already mentioned, they are positioned at any location in the engine space.

In internal combustion engines having fuel lines extending within the cylinder head, a comparatively large amount of heat is transferred from the cylinder head into the fuel along the fuel flow path. The longer the fuel remains in the cylinder head, the greater is the heat transfer. This results, on the one hand, in excessive heating of the fuel, but, on the other hand, in fuel which is unevenly heated with regard to the individual cylinders. Because of the close dependence of the fuel volume on temperature, this then results in a nonuniform fuel flow to the individual injection valves.

Since fuel viscosity is likewise temperature-dependent, there are not only uneven injection quantities, but also sharply varying injection pressures, particularly in the case of internal combustion engines with pump/nozzle arrangements or plug-in pumps.

SUMMARY OF THE INVENTION

Accordingly, it is an object of the present invention to provide a fuel distribution arrangement for internal combustion engines which overcomes the disadvantages of the prior art.

Another object of the invention is to provide a fuel distribution arrangement for internal combustion engines having a cylinder head which provides equalization of temperatures of fuel streams supplied to individual fuel injectors and furthermore lowers the overall temperature level of the fuel.

These and other objects of the invention are attained by providing a fuel-carrying passage extending in the longitudinal direction of the internal combustion engine which is an integral part of the cylinder head of the internal combustion engine, and an axially extending tubular insert in the passage so as to form coaxial inner and outer ducts leading to the injectors. In one embodiment the insert has a central fuel inflow duct which is connected to the outer duct by outflow orifices from the inflow duct.

The fuel enters the inflow duct at a specific temperature and, as it flows within the insert, the fuel is heated by the heat in the cylinder head which is generated by operation of the internal combustion engine. The fuel flowing into the end of the passage at the outflow end of the insert is further heated as it flows along the passage but some temperature equalization occurs as a result of transmission of heat from the passage to the inner inflow duct. A relatively cool fuel stream passes through the inflow path within the insert, whereas the duct outside the insert is relatively warm. In addition to the equalization resulting from heat transmission through the insert, a further equalization results because of the flow of fuel from the inflow duct into the outer duct through the defined outflow orifices. The fuel from these orifices mixes with the comparatively warm fuel flowing in the outer duct and thus reduces the overall temperature of the fuel level and assures a substantially uniform temperature distribution throughout the length of the outer duct. As a result, fuel is supplied to the individual cylinders at a temperature which is within a relatively narrow temperature range, so that equal quantities of fuel are supplied to the fuel injectors.

A reduction in the overall temperature level of the fuel is achieved because the fuel flows into the passage through the inflow duct within the insert, thus being protected against direct heat radiation from the cylinder head.

Equalization and cooling can be optimized by coordinating the cross sections of the inflow duct, of the cylinder head passage, and of the lines connecting the passage with the injectors.

The fuel distribution arrangement according to the invention also provides the advantages that pressure pulsations which are induced by the cutoff action of the individual injectors are damped. This is particularly important in the case of internal combustion engines operating with high-pressure injection, for example in the case of pump/nozzle arrangements since such pressure pulsations may adversely influence the operation of adjacent injectors with respect to fuel quantity and pressure. The damping of such pressure pulsations also results in a marked reduction in injection noise since elimination of pressure peaks prevents the fuel pressure from falling below the vapor pressure. If the fuel pressure falls below the vapor pressure, voids often occur which implode and produce a large volume of noise.

Preferably, each cylinder of the internal combustion engine communicates with at least one outflow orifice from the insert, and the outflow orifices preferably have cross-sectional areas differing from one another. In one embodiment, particularly good results are obtained if the cross-sectional areas of the orifices increase in the direction along the fuel flow passage. This ensures that, even if fuel heating increases as the fuel flows along the inflow duct, a sufficiently large quantity of fuel is available to reduce the temperature of the fuel flowing in the duct along the outside of the insert.

Furthermore, the insert is preferably provided with projections on its outer surface to support it within the passage in the cylinder head. These projections preferably have a circumferential shape with a comparatively small axial extent and are provided with perforations through which the fuel flows along the outer duct outside of the insert.

In order to assure secure mounting of the insert in the passage and to reliably avoid noise-inducing vibrations of the insert, the supports may include axially continuous ribs extending along the outer surface of the insert, the radial extent of the ribs being reduced in the region of the outflow openings for the lines leading to the injectors, thereby producing a peripheral, groove-like duct for supplying the fuel flowing between the ribs to the injector lines.

In a further embodiment, in order to counteract a possibly uneven transfer of heat from the cylinder head into the passage, the ribs may extend helically along the insert rather than longitudinally so that the entire fuel stream can flow adjacent to all the regions of the cylinder head which have different temperatures.

U.S. Pat. No. 5,273,007 discloses an insert with axially continuous supports in a passage for a completely different purpose. That arrangement provides for the distribution of oil within a rotating camshaft and makes it possible to guide a plurality of oil streams in the camshaft independently of one another.

In a further embodiment which is particularly advantageous with respect to temperature reduction, ducts for carrying cooling water within the cylinder head extend into the immediate vicinity of the passage, thereby preventing an excessive transfer of heat from the cylinder head into the fuel.

BRIEF DESCRIPTION OV THE DRAWINGS

Further objects and advantages of the invention will be apparent from a reading of the following description in conjunction with the accompanying drawings, in which.

DESCRIPTION OF PREFERRED EMBODIMENTS

Figure 1:
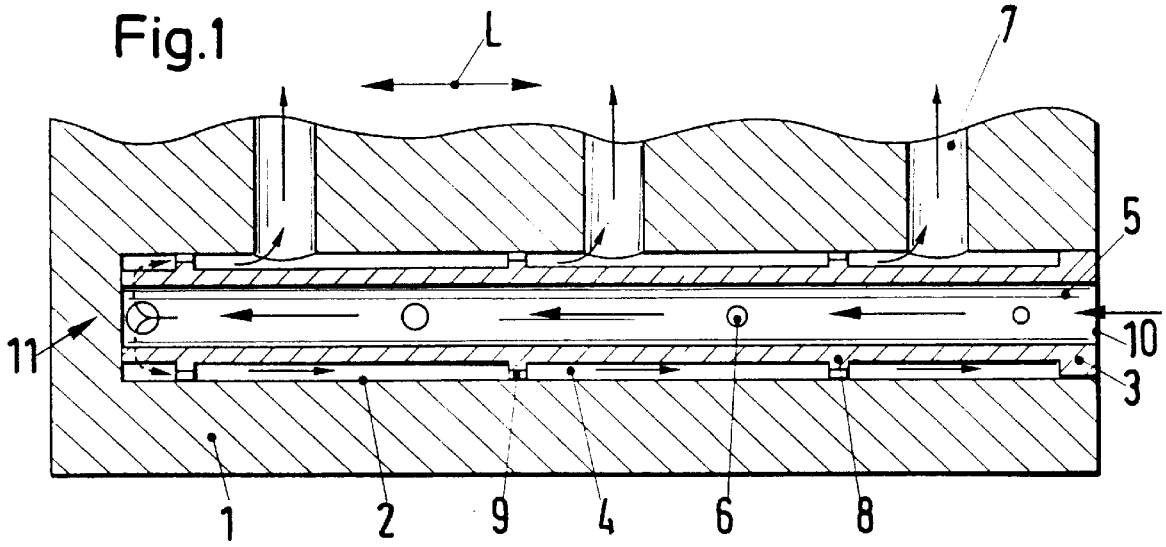
FIG. 1 is a longitudinal sectional view of a portion of a cylinder head showing a representative embodiment of a fuel distribution arrangement according to the invention.
Figure 2:
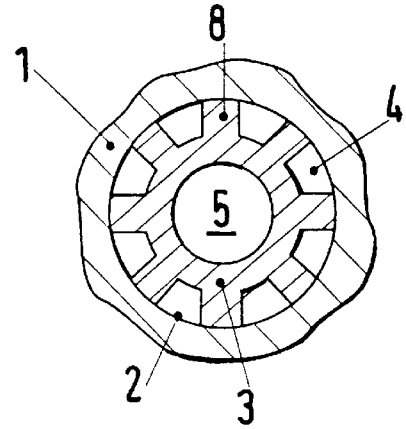
FIG. 2 is a cross section of the embodiment shown in FIG. 1.

In the typical embodiment of the invention shown in FIGS. 1 and 2, a cylinder head 1 for an internal combustion engine is formed with a cylindrical passage 2 and has an insert 3 mounted therein.

The insert 3 extends axially in the longitudinal direction L of the internal combustion engine and forms an outer duct 4 located coaxially between said insert and the wall of the passage 2.

Within the insert 3 there is a central fuel inflow duct 5 which is connected to the outer duct 4 by outflow orifices 6 having precisely determined cross-sectional areas.

Formed in the cylinder head 1 are transverse lines 7 which extend from the passage 4 to supply fuel to corresponding fuel injectors for injecting fuel into the individual cylinders of the internal combustion engine.

The insert 3, which has supports 8 formed on its outer surface, is mounted in the recess 2. For an unimpeded overflow of fuel into the individual transverse lines 7 which intersect the outer duct 4, the supports 8 have a plurality of perforations 9 on their circumference. When the internal combustion engine is operating, the fuel, received through an inlet 10 at the right-hand end as seen in FIG. 1, is heated as it flows along the flow path marked by directional arrows. Heat is introduced from the heated cylinder head 1 into the fuel primarily through the interface between the passage 2 and cylinder head 1, that is to say, into the fuel flowing in the outer duct 4. Further heat transmission takes place from the outer duct 4 through the wall of the insert 3 to the fuel flowing in countercurrent direction in the inflow duct 5. Part of the total fuel volume supplied through the inlet 10 passes through the outflow orifices 6 from the inflow duct 5 into the outer duct 4 before the fuel reaches the left-hand end 11 of the passage 2 as seen in FIG. 1.

The size of the cross-sectional areas of the outflow orifices 6 increases in the direction of the flow path in the inflow duct 5, so that the decreasing temperature gradient in relation to the fuel in the outer duct 4 is compensated by an increased volume flow.

In prior art arrangements for the distribution of fuel, temperature differences of up to 250° Celsius in the fuel applied to the fuel injectors have been measured between the first and the last cylinder of an in-line internal combustion engine. This leads to a highly uneven supply of fuel and consequently unacceptable engine operation. Using the fuel distribution arrangement according to the invention, the temperature differences among all of the cylinders are within a tolerance range of approximately 40° Celsius.

Figure 3:
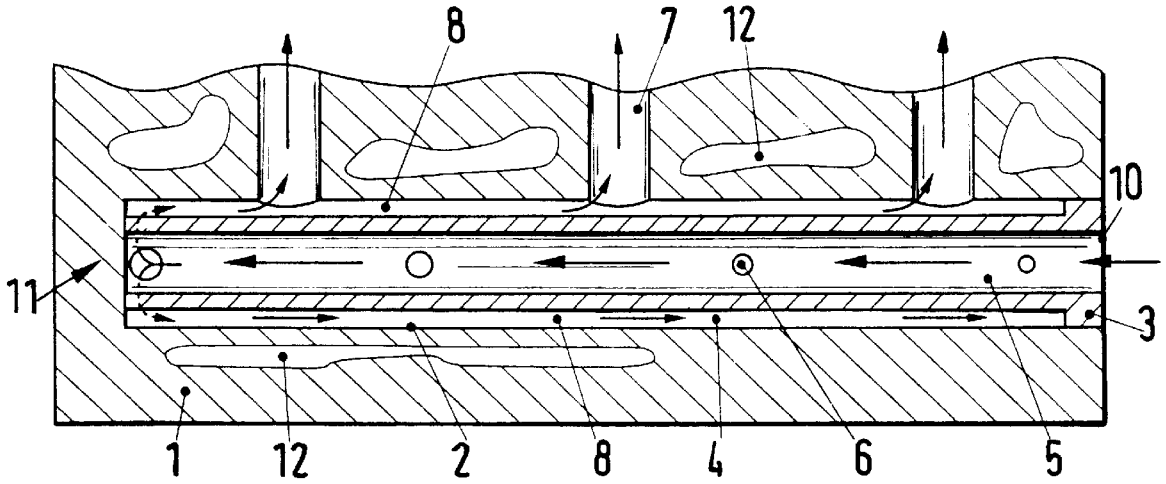
FIG. 3 is a view similar to that of FIG. 1 showing a further representative embodiment of the invention.

In a modified embodiment of the invention shown in FIG. 3, the supports 8 extend axially continuously along the outer surface of the insert 3 and thus assure a vibration-free fit within the passage 2. The radial extent of the supports 8 is reduced in the region of the transverse lines 7 so that a peripheral groove is provided for the unimpeded exchange of the fuel flowing in the channels between the individual supports 8.

In both of the foregoing embodiments, to further reduce the temperature level, the cooling water flow paths within the cylinder head 1 may be arranged so that some coolant chambers 12 as provided in the immediate vicinity of the passage 2 as shown in FIG. 3.

For equalizing the heat exchange, the supports 8 on the outer surface of the insert 3 may extend in a helical path around the inflow duct 5.

By an appropriate selection of material for the insert 3, the entire arrangement may be adapted to the particular type of use. For example, with an aluminum material having a good thermal conductivity, comparatively high heat exchange takes place in countercurrent flow between the inflow duct 5 and the outer duct 4, whereas, with a low thermal conductivity material, a comparatively high temperature difference is maintained. Further controllable parameters are the cross-sectional areas of the outflow orifices 6 and all of the other flow cross sections.

Also, depending on requirements, all of the outflow orifices 6 may have the same cross-sectional area or else, in contrast to the arrangement shown in FIG. 1, they may be larger near the inlet end 10 than at the inner end 11.

In contrast to the embodiments shown in FIG. 1 and FIG. 3, it is also possible, for a further reduction in the temperature level, to insert a ceramic tubular body, for example, along the entire inner surface of the passage 2, into which the insert 3 is then mounted, the tubular body having outflow orifices in the region of the transverse lines 7 only.

Although the invention has been described herein with reference to specific embodiments, many modifications and variations therein will readily occur to those skilled in the art. Accordingly, all such variations and modifications are included within the intended scope of the invention.

I claim:

1. A fuel distribution arrangement for an internal combustion engine comprising a cylinder head having an integral fuel-carrying passage extending in a longitudinal direction of the internal combustion engine from which fuel is supplied to fuel injectors in the cylinder head for individual cylinders of the internal combustion engine; and an axially extending tubular insert in the passage forming a coaxial outer duct communicating with the fuel injectors and having a central fuel inflow duct which is connected to the outer duct through outflow orifices in the insert.

2. An arrangement according to claim 1 wherein at least one outflow orifice is provided for each cylinder of the internal combustion engine.

3. An arrangement according to claim 1 wherein at least some of the outflow orifices have cross-sectional areas which differ from each other.

4. An arrangement according to claim 3 wherein the cross-sectional areas of the outflow orifices increase in the direction of flow along the inflow duct.

5. An arrangement according to claim 1 including supports on the outer surface of the insert for mounting the insert in the passage.

6. An arrangement according to claim 5 wherein the supports are formed with perforations on their outer circumference.

7. An arrangement according to claim 5 including transverse lines in the cylinder head for connecting the outer duct to the injectors and wherein the supports extend axially continuously along the outer surface of the insert so as to form channels in the outer duct, the radial extent of the supports being reduced in the region of the transverse lines so as to form a circumferential duct.

8. An arrangement according to claim 7 wherein the supports extend helically along the surface of the insert.

* * * * *